US009365966B2

(12) United States Patent
Kim

(10) Patent No.: US 9,365,966 B2
(45) Date of Patent: Jun. 14, 2016

(54) SUSPENSION FOR FULL AUTOMATIC WASHING MACHINE

(71) Applicant: Dongbu Daewoo Electronics Corporation, Seoul (KR)

(72) Inventor: Man Ki Kim, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 114 days.

(21) Appl. No.: 14/169,101

(22) Filed: Jan. 30, 2014

(65) Prior Publication Data

US 2015/0184329 A1 Jul. 2, 2015

(30) Foreign Application Priority Data

Dec. 26, 2013 (KR) ..... 10-2013-0163879

(51) Int. Cl.
*F16M 1/00* (2006.01)
*D06F 37/26* (2006.01)
*D06F 37/24* (2006.01)

(52) U.S. Cl.
CPC ..... *D06F 37/268* (2013.01); *D06F 37/24* (2013.01); *D06F 37/266* (2013.01)

(58) Field of Classification Search
CPC ..... D06F 37/268; D06F 37/266; D06F 37/24
USPC ..... 248/610–613, 624, 625, 638; 68/23.1, 68/23.2, 140
See application file for complete search history.

(56) References Cited

U.S. PATENT DOCUMENTS

| | | | | |
|---|---|---|---|---|
| 2,421,822 | A * | 6/1947 | Wood | 248/543 |
| 3,120,951 | A * | 2/1964 | Finch | 267/175 |
| 4,549,859 | A * | 10/1985 | Andrione et al. | 417/363 |
| 6,336,626 | B1 * | 1/2002 | Zucchini | 267/70 |
| 6,397,643 | B1 * | 6/2002 | Chang et al. | 68/23.3 |
| 2004/0231373 | A1 * | 11/2004 | Kim et al. | 68/23.1 |
| 2007/0137264 | A1 | 6/2007 | Kawabata et al. | |
| 2011/0247372 | A1 * | 10/2011 | Miller et al. | 68/13 R |
| 2012/0011894 | A1 | 1/2012 | Chang | |

FOREIGN PATENT DOCUMENTS

| | | |
|---|---|---|
| KR | 2019900003009 | 2/1990 |
| KR | 2019980023316 | 7/1998 |
| KR | 10-0253221 | 5/2000 |
| KR | 10-0253222 | 5/2000 |

(Continued)

OTHER PUBLICATIONS

Korean Patent Abstracts, Publication No. 10-0253221, Published May 1, 2000, KIPO, Republic of Korea.

(Continued)

*Primary Examiner* — Gwendolyn W Baxter

(57) ABSTRACT

A suspension for an automatic washing machine is provided. The suspension includes a main body, a tub having a drum therein coupled to the main body, a snubber bar having one end connected to a cabinet of the washing machine and another end in the main body, a seal at to a lower end of the snubber bar and configured to slide and/or move in the main body, and one or more springs in the main body, configured to apply an elastic force to the seal when the seal slides and/or in the main body, and including at least two sections having different spring constants.

14 Claims, 6 Drawing Sheets

(56) References Cited

FOREIGN PATENT DOCUMENTS

| | | | | |
|---|---|---|---|---|
| KR | 100308264 | * | 8/2001 | ..... D06F 37/24 |
| KR | 100970881 | * | 7/2010 | ..... D06F 37/24 |
| WO | WO9637651 | * | 11/1996 | ..... D06F 37/20 |
| WO | 2011057372 | | 5/2011 | |

OTHER PUBLICATIONS

Korean Patent Abstracts, Publication No. 10-0253222, Published May 1, 2000, KIPO, Republic of Korea.

Korean Notice of Allowance dated May 28, 2015 issued in corresponding Korean Patent Application No. 10-2013-0163879.

* cited by examiner

SUSPENSION FOR FULL AUTOMATIC WASHING MACHINE

CROSS-REFERENCE TO RELATED APPLICATIONS

This application is based on and claims priority from Korean Patent Application No. 2013-0163879, filed on Dec. 26, 2013, the disclosure of which is incorporated herein in its entirety by reference.

TECHNICAL FIELD

The present disclosure relates to a suspension for an automatic washing machine.

BACKGROUND

In general, an automatic washing machine is designed to remove contaminants from clothes, bedclothes, etc. (hereinafter referred to as "laundry"), using friction and the impact of water flow caused by the rotation of a pulsator or other member in a drum containing water and detergent.

In general, when washing or spin-drying is performed after the laundry is placed in the drum, the laundry may gather at one side of the drum causing an unbalanced state of laundry in the drum.

Fewer problems may occur if the laundry is spread around the drum evenly while the drum is being rotated during the washing operation. If the drum is unbalanced, however, vertical and horizontal vibrations may be generated in the drum. Such vibrations may increase in magnitude as the laundry in the drum becomes more unbalanced.

Vibrations caused by the unbalance of laundry in the drum may result in audible noise. Furthermore, the vibrations may cause the drum to collide with a tub surrounding the drum or a cabinet that encloses the tub and drum and forms the exterior of the washing machine. Such collisions and may cause damage to components within the washing machine.

To solve such problems, a suspension for attenuating and/or absorbing vibrations has been proposed.

Conventional suspensions are installed at a plurality of positions along the periphery of the drum to connect a lower peripheral surface of the drum to an upper portion of the cabinet. Each suspension incorporates a spring therein such that when the drum vibrates, the vibrations can be attenuated or absorbed by the springs.

To elaborate, a conventional suspension includes a main body having an open top and an open bottom; a snubber bar inserted into the main body through the open top such that the snubber bar may slide along the main body, connected to a lower surface of a top panel of the cabinet; a seal connected to an end of the snubber bar; and a spring surrounding the snubber bar and between an uppermost surface of the seal and an uppermost surface of the main body. When the drum vibrates, the elastic force of the spring allows the main body to slide along the snubber bar in a reciprocating manner so that the vibrations may be absorbed and/or reduced.

Further, the main body is fixed to a lower peripheral surface of the drum, and an orifice or opening that allows air to flow in and out of the main body is in a sidewall of the main body. The opening may be at a position higher than that of the seal when the spring is maximally compressed. In this configuration, if the seal is raised or lowered as the spring is compressed, the air between the seal and the top surface of the main body may flow out of the main body through the opening, and the outside air may flow into the main body through the opening. Accordingly, it may be possible to achieve an air damping effect that applies resistance to the movement of the seal.

An automatic washing machine that includes a conventional suspension may fail to achieve sufficient vibration damping when the weight of the laundry in the drum is small and/or in an unbalanced state in which the laundry is agglomerated at a side of the drum, for example at a left or right side and/or an upper or lower side, the spring within the suspension may be barely transformed by the vibration of the drum, resulting in a failure to achieve sufficient vibration damping. Furthermore, since the downward movement of the drum is small, the drum may vibrate vertically raising the risk that the drum may collide with the top plate of the cabinet.

Moreover, when the weight of the laundry in the drum is large and unbalanced, a compression amount of the spring within the suspension may increase and/or be excessive. As a result, vibrations may not be dampened effectively. Furthermore, as the seal is raised, the amount of the air that exists above the seal within the main body may decrease, resulting in a failure to achieve sufficient air damping effect.

Conventional suspensions may be disclosed in Korean Patent No. 10-0253221 (Registered on Jan. 22, 2000) and Korean Patent No. 10-0253222 (Registered on Jan. 22, 2000).

SUMMARY

The present disclosure has been made in an effort to provide a suspension for an automatic washing machine capable of attenuating and/or sufficiently absorbing vibrations of a drum in a washing or spin-drying process regardless of the weight of laundry in the drum.

Embodiments of the present disclosure provide a suspension for an automatic washing machine including a main body; a tub coupled to and/or supported by the main body; a snubber bar having one end connected to a cabinet and another end in the main body; a seal at a lower end of the snubber bar and configured to slide and/or move in the main body (e.g., along the direction of the snubber bar); and one or more springs in the main body configured to apply an elastic force to the seal when the seal slides and/or moves in the main body, and including at least two sections having different spring constants. Alternatively, two springs having different spring constants are arranged vertically within the main body.

The springs may comprise a first elastic section and a second elastic section, and the first elastic section and the second elastic section may be different from each other in at least one of an inner diameter, a number of active coils, a mean diameter, and an elastic modulus. Alternatively, the first elastic section and the second elastic section may be different from each other in at least one of length and compressive strength.

The main body may include an upper body and a lower body. An outer diameter of the upper body may be smaller than an outer diameter of the lower body, and a contact portion that connects the spring or the uppermost spring may be an interface between the upper body and the lower body.

An upper opening may be at the top of the main body and a lower opening may be at the bottom of the main body. The lower opening may be sealed by the seal. Further, at least one orifice or opening may be in a sidewall of the main body, and the orifice or opening may be at a position higher than the highest possible position of the seal (e.g., with respect to the main body) and lower than the contact portion.

A sealing ring may be in the upper body, configured to suppress a flow of air through the upper opening.

According to some embodiments, it is possible to attenuate vibrations of the drum and the tub effectively in a washing or spin-drying process regardless of the weight of the laundry put into the drum.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawings, which form a part hereof.

The illustrative embodiments described in the detailed description, drawings, and claims are not meant to be limiting. Other embodiments may be utilized, and other changes may be made, without departing from the spirit or scope of the subject matter presented here.

Figure 1:
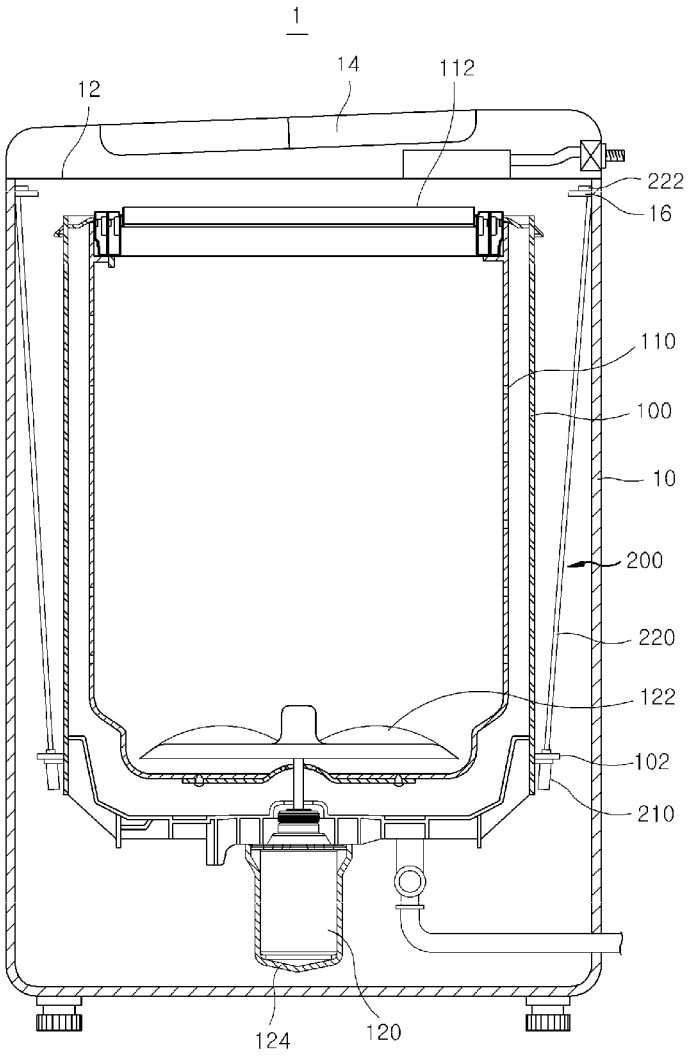
FIG. 1 is a cross sectional view illustrating the inside of an exemplary automatic washing machine according to embodiments of the present disclosure.

FIG. 1 is a cross sectional view illustrating the inside of an exemplary automatic washing machine 1 according to embodiments of the present disclosure.

Referring to FIG. 1, the automatic washing machine 1 may include a cabinet 10 that forms the exterior of the washing machine; a tub 100 in the cabinet 10; a drum 110 in the tub 100 configured to rotate and perform a washing operation on laundry using water and detergent therein or to perform a spin-drying operation for extracting water from the laundry; a motor 120 configured to rotate the drum 110; and a suspension 200 that connects the tub 100 and the cabinet 10 and is configured to attenuate and/or absorb vibration of the tub 100.

The cabinet 10 includes a cover 14 provided at a top plate 12, and the cover 14 opens and closes the cabinet 10. Laundry or the like can be loaded into the drum 110 through an opening formed in the top plate 12 of the cabinet 10 after the cover 14 is opened. When the washing or spin-drying process is performed, the cover 14 may stay closed.

The motor 120 may be in a motor case 124 under the tub 100 and may be coupled to a pulsator 122 within the drum 110.

When the laundry is washed or spin-dried and the drum 110 is rotated, the laundry may not be evenly spread within the drum 110 in a balanced manner. Instead, it is common for laundry to become agglomerated and/or gathered at one side of the drum 110. If the drum 110 is rotated in such an unbalanced state, the drum 110 may produce vibrations. Such vibration of the drum 110 may be transferred to the tub 100. As the degree of the unbalance of the drum 110 increases, the magnitude of the vibrations may also increase. When the vibrations reach a sufficiently high magnitude, the drum 110 may collide with an inner surface of the tub 100 and/or the tub 100 may collide with the cabinet 10. Components within the automatic washing machine 1 may be damaged as a result, and disturbing noises may be generated by the vibrations and collisions.

In order to reduce the vibrations of the drum 110 and the tub 100, suspensions 200 are utilized. Each suspension 200 connects to a lower peripheral surface of the tub 100 and an upper portion of the cabinet 10 to serve as a damper. One end of the suspensions 200 are fastened to lower fastening members 102 along the lower peripheral surface of the tub 100, while the other end of the suspensions 200 are fastened to upper fastening members 16 at the upper portion of the cabinet 10. Each suspension 200 may be supported by the upper fastening member 16 with its flange 222 held on the upper fastening member 16. With this configuration, the suspension 200 can be rotated about the upper fastening member 16. Thus, even when the suspension 200 is swung by the vibration of the tub 100, the upper fastening members 16 and the suspensions 200 can still prevent damage.

Figure 2:
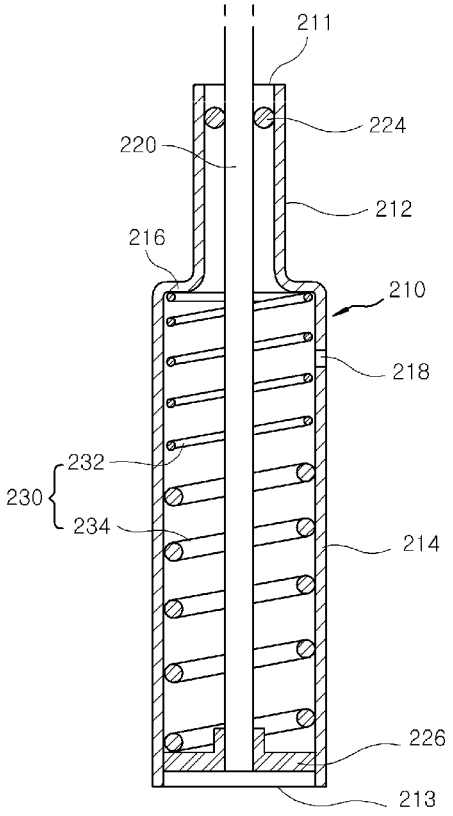
FIG. 2 is a cross sectional view illustrating an exemplary suspension of the washing machine of FIG. 1.
Figure 3:
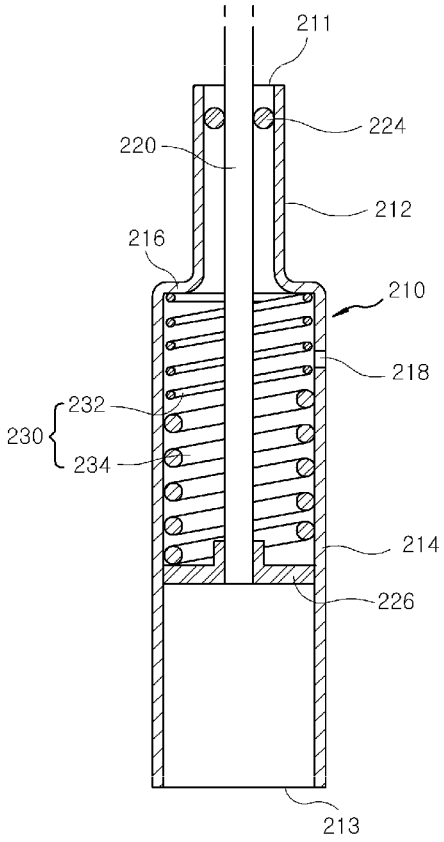
FIG. 3 is a cross sectional view showing the spring illustrated in FIG. 2 in an exemplary compressed state.

FIG. 2 and FIG. 3 illustrate a specific configuration of the suspension 200. FIG. 2 is an exemplary cross sectional view illustrating the inside of the suspension of FIG. 1, and FIG. 3 is an exemplary cross sectional view showing a state where a spring of FIG. 2 is compressed.

Referring to FIG. 2 and FIG. 3, according to some embodiments, the suspension 200 may include a main body 210 coupled to the tub 100 and having a hollow portion inside; a snubber bar 220 of which one end is coupled to the cabinet 10 and another end (e.g., an opposite end) is in the main body 210; a seal 226 at a lower end of the snubber bar 220 and configured to slide and/or move while in contact (optionally in close contact) with the main body 210; a spring 230 in the hollow portion configured to apply an elastic force to the seal 226 when the seal 226 slides along the inner surface of the main body 210. The spring 230 may comprise a plurality of sections having different spring constants.

In the following description of the suspension 200, the opening where the snubber bar 220 may be inserted into the main body 210 will be referred to as an upper side or end, and the opposite side thereto will be referred to as a lower side or end.

The main body 210 has a circular cross section and may have an upper opening 211 at the top of the hollow portion and a lower opening 213 at the bottom of the hollow portion. The main body 210 may comprise an upper body 212 and a lower body 214. An outer diameter of the upper body 212 may be smaller than an outer diameter of the lower body 214. Further, a contact portion 216 that connects the spring 230 (or the uppermost spring in a two-spring solution) may be at an interface between the upper body 212 and the lower body 214. Further, at least one orifice or opening 218 may be in a sidewall of the main body 210. Air flows into or out of the main body through the orifice or opening 218.

The opening 218 may be higher than the highest possible position of the seal 226 (e.g., with respect to the main body 210) and lower than the position of the contact portion 216.

The snubber bar 220 may have a cylindrical shape and/or a circular cross section, and may comprise a high-strength material such as steel or an aluminum alloy. The snubber bar 220 may be inserted into the main body 210 through the upper opening 211 of the main body 210. Alternatively, an unsealed end of the main body 210 (e.g., upper opening 211) may be placed over the snubber bar 220.

The seal 226 for sealing the inside of the main body 210 may be at the end of the snubber bar 220 that is in the main body 210. The lower opening 213 of the main body 210 may be sealed by the seal 226. With this configuration, if the seal 226 is raised or lowered with respect to the main body 210 (along with the movement of the snubber bar 220), the outside air may flow into the main body 210 through the orifice or opening 218 and/or the air inside the main body 210 may flow out of the main body 210 through the opening 218. Pressure generated when the air flows into and/or out of the main body through the opening 218 may apply resistance to the movement of the seal 226. In this configuration, opening 218 may have a small diameter. This resistance may provide an air dampening effect.

Further, the seal 226 may be made of, but not limited to, an elastic material having a small frictional force to allow the snubber bar 220 to be softly slid against the main body 210 (e.g., a small frictional force is applied to the main body 210).

Meanwhile, the flange 222 may be at another end of the snubber bar 220 (e.g., opposite to seal 226). Further, a sealing ring 224 for suppressing a flow of air through the upper opening 211 may be at the upper body 212. The sealing ring 224 seals the upper opening 211 while allowing the snubber bar 220 to slide and/or move while in contact with the upper body 212.

According to some embodiments, the sealing ring 224 is connected to an inner surface of the upper body 212. Alternatively, the sealing ring 224 may be connected to the snubber bar 220 and moved together with the snubber bar 220 when the snubber bar 220 moves and/or slides.

An end of the spring 230 is connected to the contact portion 216, while its other end is connected to the seal 226. With this configuration, when the seal 226 moves and/or slides, the spring 230 may apply an elastic force to the seal 226.

The spring 230 may comprise a first elastic section 232 and a second elastic section 234. The first elastic section 232 and the second elastic section 234 have different spring constants. In a two-spring solution, a plate or washer may be inserted between the two elastic sections to absorb vibrations occurring in the spring 230, to provide flat and/or stable surfaces in contact with each spring, and to prevent the two elastic sections from separating.

To elaborate, a spring constant K is calculated by the following equation.

$$K=Gd4/8NaD3(\text{Kgf/mm})$$

Here, G represents a modulus of rigidity of a material; d, a linear diameter of a spring; Na, the number of active coils; D, a mean diameter (an average of an inner diameter and an outer diameter) of the spring.

In the present exemplary embodiment, the first elastic section 232 and the second elastic section 234 have different linear diameters. When the linear diameter of the first elastic section 232 is smaller than that of the second elastic section 234, the spring diameter of the first elastic section 232 may also be smaller than that of the second elastic section 234.

Furthermore, the first elastic section 232 and the second elastic section 234 may have different lengths, different numbers of active coils, or different mean diameters, or may comprise or be made of materials having different elastic modulus. In the present exemplary embodiment, the single spring 230 is divided into the first elastic section 232 and the second elastic section 234. However, two separate springs having different spring constants may be connected and form a compound spring. A plate and/or washer may be between the two individual springs to provide a flat and/or stable interface between the two springs, absorb and/or attenuate vibrations in the springs, and/or prevent the two springs from separating.

While embodiments of the present invention have been described as having a single spring 230 divided into the two parts having different spring constants, other configurations are contemplated. By way of non-limiting example, the spring 230 may be composed of three or more sections having different spring constants. The spring 230 may comprise a first elastic section and a second elastic section, and the first elastic section and the second elastic section may be different from each other in at least one of an inner diameter, a number of active coils, a mean diameter, and an elastic modulus. Alternatively, the first elastic section and the second elastic section may be different from each other in at least one of length and compressive strength.

Figure 4:
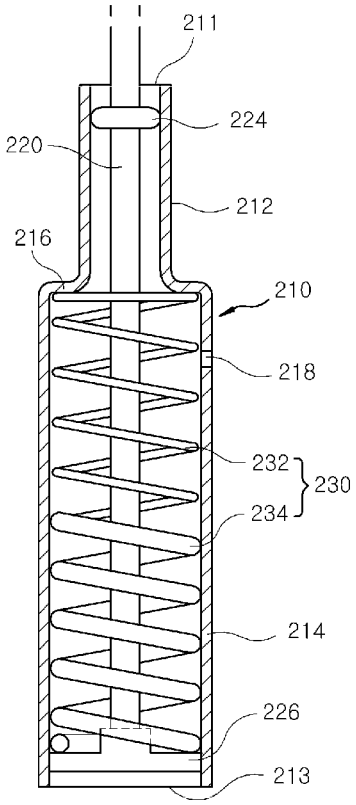
FIG. 4 is a diagram showing an exemplary initial state of the spring illustrated in FIG. 2.
Figure 5:
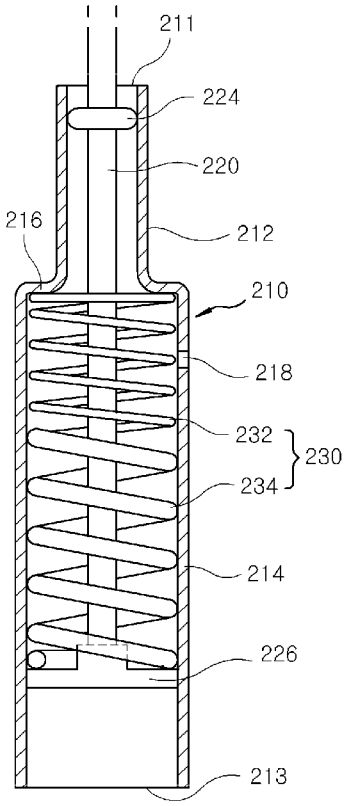
FIG. 5 is a diagram showing the first elastic member illustrated in FIG. 2 in an exemplary compressed state.
Figure 6:
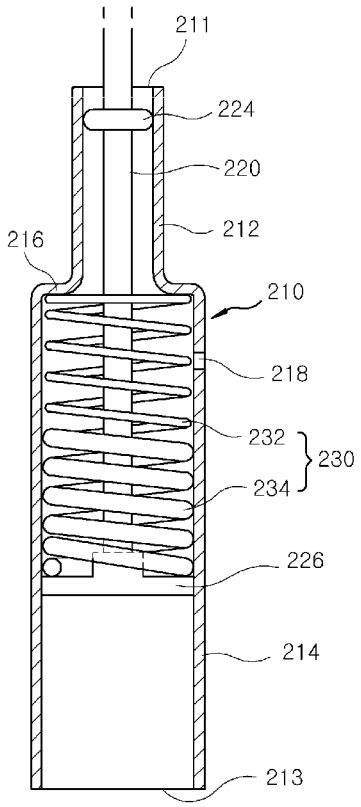
FIG. 6 is a diagram showing the first elastic member and the second elastic member illustrated in FIG. 2 in exemplary compressed states.

Now, the suspension 200 having the above-described configuration will be discussed with reference to FIG. 4 to FIG. 6. FIG. 4 is a diagram illustrating an exemplary initial state of the spring illustrated in FIG. 2. FIG. 5 is a diagram illustrating the first elastic member illustrated in FIG. 2 in an exemplary compressed state. FIG. 6 is a diagram illustrating the first and second elastic members illustrated in FIG. 2 in exemplary compressed states.

Referring to FIG. 4 to FIG. 6, when water and laundry are not in the tub 100 or the drum 110, the spring 230 within the main body 210 may maintain its initial state (FIG. 4).

In this state, if water and/or laundry are placed into the tub 100 and the drum 110, the first elastic section 232 having a smaller spring constant may be first compressed. If additional laundry and/or water are added to the tub 100 after the first elastic section 232 is maximally compressed (FIG. 5), the second elastic section 234 also compress.

Once a washing or spin-drying operation begins (after the laundry is in the drum), the drum 110 is rotated, and a centrifugal force may be applied to the laundry within the drum 110 and may cause the laundry to adhere to the inner wall surface of the drum 110. At this time, if the laundry is evenly spread across the inside of the drum 110 in a balanced manner, the drum 110 may not vibrate greatly. If the laundry is unbalanced (e.g., concentrated at one side of the drum 110), however, the drum 110 and the tub 100 may vibrate greatly.

If the tub 100 rocks and/or moves against the cabinet 10 due to the vibrations of the drum 110 and/or the tub 100, the main body 210 of the suspension 200 may rock and/or move against the snubber bar 220 in a vertical direction. Accordingly, the snubber bar 220 and the seal 226 connected to the snubber bar 220 are allowed to move and/or slide within the main body 210. As the seal 226 moves and/or slides, the spring 230 may be compressed or extended.

If the weight of the laundry in the drum 110 is relatively small, the washing or spin-drying operation may start when the first elastic section 232 is not maximally compressed. In this state, if vibration is generated due to unbalanced laundry in the drum 110 after the washing or spin-drying operation has started, the first elastic section 232 may apply an elastic force to the seal 226 so that vibration can be absorbed/reduced.

On the other hand, if the weight of the laundry in the drum 110 is relatively large, the washing or spin-drying operation may start when the first elastic section 232 is maximally compressed. If vibrations are generated due to unbalanced laundry in the drum 110 after the washing or spin-drying operation is begun, the second elastic section 234 may apply an elastic force to the seal 226 so that vibration may be reduced and/or absorbed. Further, depending on the weight of the laundry, a vibration damping effect may be produced by both the first elastic section 232 and the second elastic section

234. With this vibration damping mechanism, a cover 112 of the drum 110 may be prevented from colliding with the cover 14 of the cabinet 10.

The suspension 200 having the above-described configuration according to the present exemplary embodiment may reduce vibrations of the drum 110 and the tub 100 regardless of the weight of the laundry in the drum 110 when a washing or spin-drying operation is performed.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. A suspension for an automatic washing machine, comprising:

a main body;

a tub having a drum therein coupled to the main body;

a snubber bar having one end connected to a cabinet of the washing machine and another end in the main body;

a seal at a lower end of the snubber bar and configured to slide or move in the main body; and one or more springs in the main body, configured to apply an elastic force to the seal when the seal slides or moves in the main body, and comprising at least two sections having different spring constants, wherein the main body includes:

an upper body and a lower body;

an upper opening at the top of the main body;

a lower opening at the bottom of the main body; and a sealing ring in the upper body, configured to suppress a flow of air through the upper opening.

2. The suspension of claim 1, wherein the springs comprise a first elastic section and a second elastic section, and the first elastic section and the second elastic section have at least one different inner diameter, number of active coils, mean diameter or elastic modulus.

3. The suspension of claim 1, wherein an outer diameter of the upper body is smaller than an outer diameter of the lower body.

4. The suspension of claim 1, wherein a contact portion that connects the spring or an uppermost spring may be an interface between the upper body and the lower body.

5. The suspension of claim 1, wherein the lower opening is sealed by the seal.

6. The suspension of claim 1, further comprising at least one opening in a sidewall of the main body.

7. The suspension of claim 1, wherein an opening is located at a position higher than a highest position of the seal with respect to the main body.

8. The suspension of claim 1, wherein an opening is located at a position lower than a position of the contact portion.

9. A suspension for an automatic washing machine, comprising:

a main body;

a tub having a drum therein coupled to the main body;

a snubber bar having one end connected to a cabinet of the washing machine and another end in the main body;

a seal at a lower end of the snubber bar and configured to slide or move in the main body; and one or more compound springs in the main body, configured to apply an elastic force to the seal when the seal slides or moves in the main body, and comprising at least two individual springs having different spring constants, wherein the main body includes:

an upper body and a lower body, wherein an outer diameter of the upper body is smaller than an outer diameter of the lower body;

an upper opening at the top of the main body;

a lower opening at the bottom of the main body; and a sealing ring in the upper body, configured to suppress a flow of air through the upper opening.

10. The apparatus of claim 9, further comprising a plate or washer between the individual springs to absorb or attenuate vibrations in the springs or prevent the two springs from separating.

11. The suspension of claim 9, wherein the compound springs comprise a first individual spring and a second individual spring, and the first individual spring and the second individual spring have at least one different inner diameter, number of active coils, mean diameter or elastic modulus.

12. The suspension of claim 9, further comprising at least one opening in a sidewall of the main body.

13. The suspension of claim 9, wherein an opening is located at a position higher than a highest position of the seal with respect to the main body.

14. The suspension of claim 9, wherein an opening is located at a position lower than a position of the contact portion.

* * * * *